US010030366B2

(12) United States Patent
Tevis et al.

(10) Patent No.: US 10,030,366 B2
(45) Date of Patent: Jul. 24, 2018

(54) DRAWBAR POSITION DETERMINATION WITH ROTATIONAL SENSORS

(71) Applicant: Caterpillar Inc., Peoria, IL (US)

(72) Inventors: Ethan M. Tevis, Bloomington, IL (US); Karl Kirsch, Chillicothe, IL (US); Michael C. Gentle, Maroa, IL (US)

(73) Assignee: Caterpillar Inc., Deerfield, IL (US)

( * ) Notice: Subject to any disclaimer, the term of this patent is extended or adjusted under 35 U.S.C. 154(b) by 299 days.

(21) Appl. No.: 15/090,191

(22) Filed: Apr. 4, 2016

(65) Prior Publication Data

US 2017/0284067 A1 Oct. 5, 2017

(51) Int. Cl.
*E02F 3/76* (2006.01)
*E02F 9/26* (2006.01)
*E02F 3/84* (2006.01)

(52) U.S. Cl.
CPC ..... *E02F 9/26* (2013.01); *E02F 3/7636* (2013.01); *E02F 3/844* (2013.01)

(58) Field of Classification Search
CPC .... E01C 19/006; E01C 19/004; E01C 19/008; E02F 3/842; E02F 3/845; E02F 3/847; E02F 3/765; E02F 3/7645; E02F 9/26; E02F 9/262; E02F 9/2012
USPC ..... 37/348, 382; 172/2–11, 793, 49.5, 58, 172/60, 59, 799, 779, 791, 812, 818, 821; 318/587; 404/84.1; 701/50
See application file for complete search history.

(56) References Cited

U.S. PATENT DOCUMENTS

RE28,979 E * 9/1976 Long ..... E02F 3/845 172/4.5
4,934,463 A 6/1990 Ishida et al.
5,327,345 A * 7/1994 Nielsen ..... E01C 19/006 172/4.5
5,951,613 A 9/1999 Sahm et al.
6,028,524 A 2/2000 Hartman et al.
6,295,746 B1 * 10/2001 Meduna ..... E02F 3/847 172/4.5
7,293,376 B2 11/2007 Glover
7,588,088 B2 * 9/2009 Zachman ..... E02F 3/765 172/4.5
7,676,967 B2 3/2010 Gharsalli et al.
8,103,417 B2 1/2012 Gharsalli et al.
8,548,690 B2 10/2013 Hayashi
8,738,242 B2 * 5/2014 Konno ..... E02F 3/845 701/50
9,085,869 B2 7/2015 Faivre
9,085,877 B2 * 7/2015 Wahlmark ..... E02F 3/764
2002/0162668 A1 * 11/2002 Carlson ..... E02F 3/847 172/4.5
2008/0087447 A1 4/2008 Piekutowski
2011/0213529 A1 9/2011 Krause et al.
2013/0304331 A1 11/2013 Braunstein et al.
2014/0326471 A1 11/2014 Zhu et al.

* cited by examiner

*Primary Examiner* — Robert E Pezzuto
(74) *Attorney, Agent, or Firm* — Miller, Matthias & Hull

(57) ABSTRACT

In a motor grader, a total drawbar position may be determined based on signals from various sensors on a drawbar-circle-moldboard (DCM) assembly. The sensors can include rotational sensors for one or both lift arm angles, and one or both yoke primary angles in combination with sensors detecting lengths of the lift cylinders. The sensor information may be used to calculate roll, pitch and yaw angles of the drawbar relative to a frame of the motor grader.

20 Claims, 8 Drawing Sheets

198

| LINK BAR POSITION | LEFT LIFT ARM ANGLE | RIGHT LIFT ARM ANGLE | xL | yL | zL | xR | yR | zR |
|---|---|---|---|---|---|---|---|---|
| FAR LEFT | 69.6945 | 51.9738 | -2107.15 | 1550.36 | -443.420 | -2107.15 | 563.721 | 597.224 |
| LEFT | 29.8172 | 23.4746 | -2107.15 | 1298.41 | -714.083 | -2107.15 | 786.368 | 769.453 |
| LEFT CENTER | 15.5806 | 10.9740 | -2107.15 | 1167.69 | -795.760 | -2107.15 | 905.275 | 806.315 |
| CENTER | 2.0261 | -2.0261 | -2107.15 | 1034.33 | -816.413 | -2107.15 | 1034.33 | 816.413 |
| RIGHT CENTER | -10.9741 | -15.5806 | -2107.15 | 905.275 | -806.315 | -2107.15 | 1167.69 | 795.760 |
| RIGHT | -23.4741 | -29.8166 | -2107.15 | 786.364 | -769.451 | -2107.15 | 1298.42 | 741.080 |
| FAR RIGHT | -51.9737 | -69.6945 | -2107.15 | 563.720 | -597.224 | -2107.15 | 1550.36 | 443.419 |

FIG. 10

DRAWBAR POSITION DETERMINATION WITH ROTATIONAL SENSORS

TECHNICAL FIELD

The present disclosure is directed to a machine such as a motor grader having a blade positioning system, and more particularly, to apparatus and methods for determining a position of a drawbar of the machine relative to a frame using signals from rotational sensors.

BACKGROUND

Motor graders are used primarily as finishing tools to sculpt a surface of a construction site to a final shape and contour. Typically, motor graders include many hand-operated controls to steer the wheels of the grader, position a blade, and articulate a front frame of the motor grader. The blade is adjustably mounted to the front frame to move relatively small quantities of earth from side to side. In addition, the articulation of the front frame is adjusted by rotating the front frame of the grader relative to the rear frame of the grader.

One example of a motor grader and a mechanism for positioning a blade of the motor grader is provided in U.S. Pat. No. 8,103,417 issued to Gharsalli et al. (the '417 patent) on Jan. 24, 2012 entitled Machine with Automated Blade Positioning System. The '417 patent discloses a motor grader having a frame to which a drawbar-circle-moldboard (DCM) assembly is mounted. A drawbar is connected to the frame by a ball and socket joint. A pair of double acting hydraulic rams connected between the frame and the drawbar affect vertical movement of the DCM assembly, and a side shift cylinder connected between the drawbar and a link bar adjustable between a plurality of predefined positions affects horizontal movement of the DCM assembly. A circle assembly may be connected to the drawbar by a motor to drivingly support a moldboard assembly having the blade and blade positioning cylinders. The DCM assembly may be controlled to rotate the circle assembly and the moldboard assembly relative to the drawbar, and the blade may be movable horizontally and vertically and oriented relative to the circle assembly via blade positioning cylinders.

To produce a final surface contour, the blade and the frame may be adjusted to many different positions. As may be apparent from the '417 patent, positioning the drawbar and the blade of a motor grader is a complex task that may require information regarding the status and position of many components of the DCM assembly. The information may be used by the operator and/or a controller to ensure that the drawbar and the blade are correctly positioned to produce the desired contour, and to adjust the drawbar and the blade if they are not in the correct position.

SUMMARY OF THE DISCLOSURE

In one aspect of the present disclosure, a motor grader is disclosed. The motor grader may include a frame, a drawbar that is multi-dimensional rotationally connected to the frame, a left lift arm pivotally connected to the frame, a right lift arm pivotally connected to the frame, a link bar pivotally connected to the left lift arm and the right lift arm, a left yoke pivotally connected to the left lift arm for rotation relative to the left lift arm about a left yoke primary axis, a left lift cylinder pivotally connected to the left yoke for rotation relative to the left yoke about a left yoke secondary axis, and multi-dimensional rotationally connected to the drawbar, a right yoke pivotally connected to the right lift arm for rotation relative to the right lift arm about a right yoke primary axis, a right lift cylinder pivotally connected to the right yoke for rotation relative to the right yoke about a right yoke secondary axis, and multi-dimensional rotationally connected to the drawbar, and a side shift cylinder multi-dimensional rotationally connected to the link bar by a first side shift cylinder connection and multi-dimensional rotationally connected to the drawbar by a second side shift cylinder connection. The motor grader may further include a left lift arm angle sensor operatively associated with the left lift arm to sense a left lift arm angle relative to the frame and output a left lift arm angle sensor signal that corresponds to the left lift arm angle, a left yoke primary angle sensor operatively associated with the left yoke to sense a left yoke primary angle relative to the left lift arm and output a left yoke primary angle sensor signal that corresponds to the left yoke primary angle, a left lift cylinder length sensor operatively associated with the left lift cylinder to sense a left lift cylinder length of the left lift cylinder and output a left lift cylinder length sensor signal that corresponds to the left lift cylinder length, and a right lift cylinder length sensor operatively associated with the right lift cylinder to sense a right lift cylinder length of the right lift cylinder and output a right lift cylinder length sensor signal that corresponds to the right lift cylinder length. The motor grader may also include a controller operatively connected to the left lift arm angle sensor, the left yoke primary angle sensor, the left lift cylinder length sensor and the right lift cylinder length sensor, with the controller being configured to calculate drawbar orientation angles of the drawbar relative to the frame based on the left lift arm angle sensor signal, the left yoke primary angle sensor signal, the left lift cylinder length sensor signal and the right lift cylinder length sensor signal.

In another aspect of the present disclosure, a method for determining drawbar orientation angles of a drawbar of a motor grader is disclosed. The drawbar of the motor grader is multi-dimensional rotationally connected to a frame of the motor grader, a link bar of the motor grader is connected to the frame by a left lift arm pivotally connected to the frame and to the link bar and a right lift arm pivotally connected to the frame and to the link bar, and the drawbar is suspended from the frame by a left lift cylinder and a right lift cylinder. The left lift cylinder is multi-dimensional rotationally connected to the drawbar and pivotally connected to a left yoke that is pivotally connected to the left lift arm, and the right lift cylinder is multi-dimensional rotationally connected to the drawbar and pivotally connected to a right yoke that is pivotally connected to the right lift arm. A side shift cylinder has a first side shift cylinder multi-dimensional rotation connection to the link bar and a second side shift cylinder multi-dimensional rotation connection to the drawbar. The method for determining the drawbar orientation angles includes calculating a left lift cylinder multi-dimensional rotation connection location relative to the frame, calculating a right lift cylinder multi-dimensional rotation connection location relative to the frame, and calculating the drawbar orientation angles of the drawbar relative to the frame based on the left lift cylinder multi-dimensional rotation connection location and the right lift cylinder multi-dimensional rotation connection location.

In a further aspect of the present disclosure, a motor grader is disclosed. The motor grader includes a frame, a drawbar mounted on the frame by a drawbar ball joint, a left lift arm pivotally connected to the frame, a right lift arm pivotally connected to the frame, a link bar pivotally connected to the left lift arm and the right lift arm, a left yoke pivotally connected to the left lift arm for rotation relative to the left lift arm about a left yoke primary axis, a left lift cylinder pivotally connected to the left yoke for rotation relative to the left yoke about a left yoke secondary axis, and connected to the drawbar by a left lift cylinder ball joint, a right yoke pivotally connected to the right lift arm for rotation relative to the right lift arm about a right yoke primary axis, a right lift cylinder pivotally connected to the right yoke for rotation relative to the right yoke about a right yoke secondary axis, and connected to the drawbar by a right lift cylinder ball joint, and a side shift cylinder connected to the link bar by a first side shift cylinder ball joint and connected to the drawbar by a second side shift cylinder ball joint. The motor grader further includes a left lift arm angle sensor operatively connected to the left lift arm to sense a left lift arm angle relative to the frame and output a left lift arm angle sensor signal that corresponds to the left lift arm angle, a right lift arm angle sensor operatively connected to the right lift arm to sense a right lift arm angle relative to the frame and output a right lift arm angle sensor signal that corresponds to the right lift arm angle, a left yoke primary angle sensor operatively connected to the left yoke to sense a left yoke primary angle relative to the left lift arm and output a left yoke primary angle sensor signal that corresponds to the left yoke primary angle, a right yoke primary angle sensor operatively connected to the right yoke to sense a right yoke primary angle relative to the right lift arm and output a right yoke primary angle sensor signal that corresponds to the right yoke primary angle, a left lift cylinder length sensor operatively connected to the left lift cylinder to sense a left lift cylinder length of the left lift cylinder and output a left lift cylinder length sensor signal that corresponds to the left lift cylinder length, and a right lift cylinder length sensor operatively connected to the right lift cylinder to sense a right lift cylinder length of the right lift cylinder and output a right lift cylinder length sensor signal that corresponds to the right lift cylinder length. The motor grader also includes a controller operatively connected to the left lift arm angle sensor, the right lift arm angle sensor, the left yoke primary angle sensor, the right yoke primary angle sensor, the left lift cylinder length sensor and the right lift cylinder length sensor. The controller is configured to calculate a left lift cylinder ball joint location relative to the frame based on the left lift arm angle of the left lift arm angle sensor signal, the left yoke primary angle of the left yoke primary angle sensor signal and the left lift cylinder length of the left lift cylinder length sensor signal, calculate a right lift cylinder ball joint location relative to the frame based on the right lift arm angle of the right lift arm angle sensor signal, the right yoke primary angle of the right yoke primary angle sensor signal and the right lift cylinder length of the right lift cylinder length sensor signal, and calculate a drawbar roll angle, a drawbar yaw angle and a drawbar pitch angle relative to the frame based on the left lift cylinder ball joint location and the right lift cylinder ball joint location.

Additional aspects are defined by the claims of this patent.

BRIEF DESCRIPTION OF THE DRAWINGS

FIG. 10 is an illustration of a global point coordinate look-up table.

DETAILED DESCRIPTION

Figure 1:
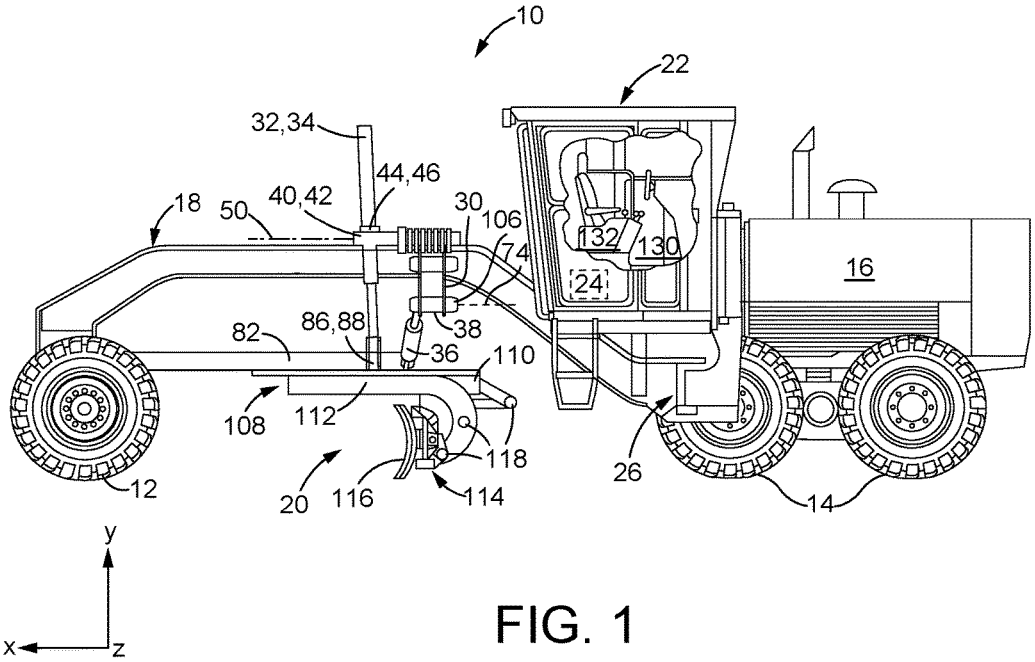
FIG. 1 is a side view of an exemplary motor grader in which apparatus and methods in accordance with the present disclosure may be implemented.

An exemplary embodiment of a machine 10 is illustrated in FIG. 1. The machine 10 may be a motor grader, a backhoe loader, an agricultural tractor, a wheel loader, a skid-steer loader, or any other type of machine known in the art, and is illustrated and referred to herein as motor grader 10. The motor grader 10 may include a steerable traction device 12, a driven traction device 14, a power source 16 supported by driven traction device 14, and a frame 18 connecting the steerable traction device 12 to the driven traction device 14. The motor grader 10 may also include a work implement such as, for example, a drawbar-circle-moldboard (DCM) assembly 20, an operator station 22, and a blade control system 24.

Both the steerable traction device 12 and the driven traction device 14 may include one or more wheels located on each side of the motor grader 10 (only one side shown). The wheels may be rotatable and/or tiltable for use during steering and leveling of a work surface (not shown). Alternatively, the steerable traction device 12 and/or the driven traction device 14 may include tracks, belts, or other traction devices known in the art. The steerable traction device 12 may or may not also be driven, while the driven traction device 14 may or may not also be steerable. The frame 18 may connect the steerable traction device 12 to the driven traction device 14 by way of, for example, an articulation joint 26. Furthermore, the motor grader 10 may be caused to articulate the steerable traction device 12 relative to the driven traction device 14 via the articulation joint 26. The motor grader 10 may also include a neutral articulation feature that, when activated, may cause automatic realignment of the steerable traction device 12 relative to the driven traction device 14 to cause the articulation joint 26 to return to a neutral articulation position.

The power source 16 may include an engine (not shown) connected to a transmission (not shown). The engine may be, for example, a diesel engine, a gasoline engine, a natural gas engine, or any other engine known in the art. The power source 16 may also be a non-combustion source of power such as a fuel cell, a power storage device, or another source of power known in the art. The transmission may be an electric transmission, a hydraulic transmission, a mechanical transmission, or any other transmission known in the art. The transmission may be operable to produce multiple output speed ratios and may be configured to transfer power from the power source 16 to the driven traction device 14 at a range of output speeds.

The frame 18 may support a fixedly connected side shift mounting bracket 30. The frame 18 may be, for example, a single formed or assembled beam having a substantially hollow square cross-section. The substantially hollow square cross-section may provide the frame 18 with a substantially high moment of inertia required to adequately support the DCM assembly 20 and the side shift mounting bracket 30. The cross-section of frame 18 may alternatively be rectangular, round, triangular, or any other appropriate shape.

Figure 2:
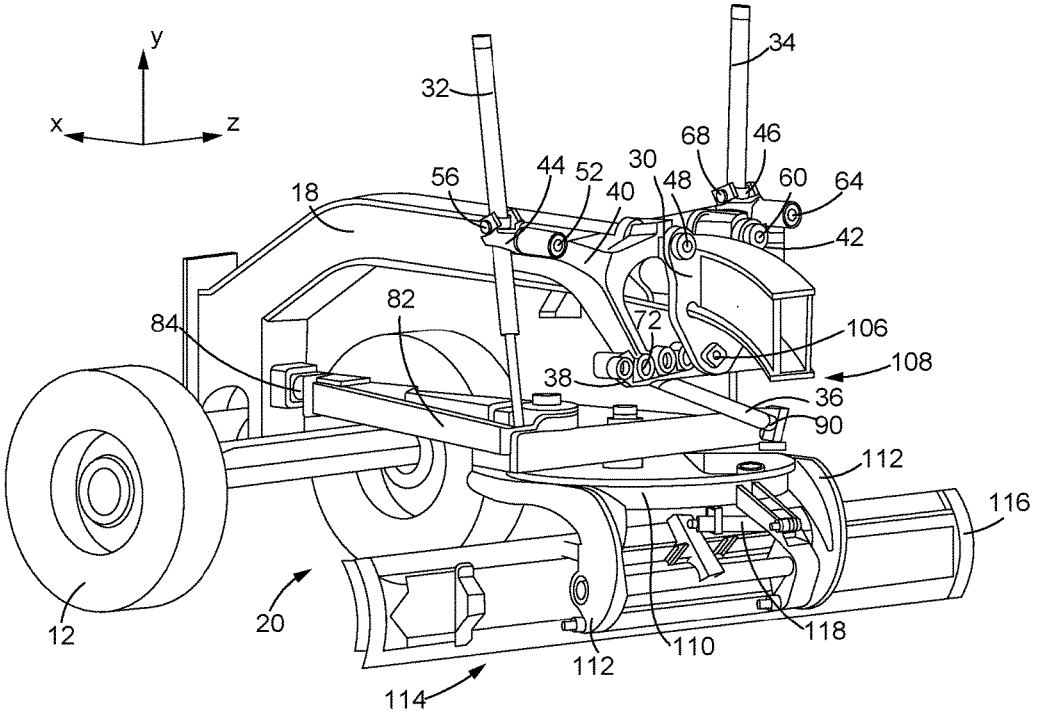
FIG. 2 is a partial isometric view of a front portion of the motor grader of FIG. 1.

The side shift mounting bracket 30 may support a left lift cylinder 32 and a right lift cylinder 34 (FIG. 2) for affecting vertical movement of the DCM assembly 20, a side shift cylinder 36 for affecting horizontal movement of the DCM assembly 20, and a link bar 38 adjustable between a plurality of predefined positions. The side shift mounting bracket 30 may be welded or otherwise fixedly connected to the frame 18 to indirectly support the left lift cylinder 32 and the right lift cylinder 34 by way of a left lift arm 40, a right lift arm 42, a left yoke 44 and a right yoke 46. That is, the left lift arm 40 may be pivotally connected to the side shift mounting bracket 30 by a left lift arm pivot pin 48 along a horizontal left lift arm axis 50, and pivotally connected to the left yoke 44 by a left yoke primary pivot pin 52 along a horizontal left yoke primary axis 54 that is parallel to the left lift arm axis 50. The left lift cylinder 32 may be pivotally connected to the left yoke 44 by a left yoke secondary pivot pin 56 along a horizontal left yoke secondary axis 58 that is perpendicular to the left yoke primary axis 54. Similarly, the right lift arm 42 may be pivotally connected to the side shift mounting bracket 30 by a right lift arm pivot pin 60 along a horizontal right lift arm axis 62, and pivotally connected to the right yoke 46 by a right yoke primary pivot pin 64 along a horizontal right yoke primary axis 66 that is parallel to the right lift arm axis 62. The right lift cylinder 34 may be pivotally connected to the right yoke 46 by a right yoke secondary pivot pin 68 along a horizontal right yoke secondary axis 70 that is perpendicular to the right yoke primary axis 66.

The left lift arm 40 and the right lift arm 42 may further be pivotally connected to the link bar 38. The link bar 38 may be pivotally connected to the left lift arm 40 by a left link bar pivot pin 72, and pivotally connected to the right lift arm 42 by a right link bar pivot pin 76 along a horizontal right link bar axis 78, with the left link bar axis 74 and the right link bar axis 78 being parallel to the left lift arm axis 50 and the right lift arm axis 62. Connected in this way, the side shift mounting bracket 30, the link bar, the left lift arm 40 and the right lift arm 42 may define a four-bar linkage with the lengths of the links between the axes 50, 62, 74, 78 being known, and the positions of the elements being determinable when an angle between two adjacent links is known. The side shift cylinder 36 may have a first side shift cylinder connection 80 attaching the side shift cylinder 36 to the link bar 38. The first side shift cylinder connection 80 may be proximate the left link bar axis 74 as shown herein, and may provide a multi-dimensional rotational connection to the link bar 38 with an appropriate connection mechanism such as a ball joint so that the side shift cylinder 36 may move relative to the link bar 38 about multiple rotational axes as necessary for the blade control system 24 to position the DCM assembly 20.

The DCM assembly 20 may include a drawbar 82 supported by the frame 18 and multi-dimensional rotational connector such as a ball and socket joint 84 (FIG. 2) located proximal the steerable traction device 12. The drawbar 82 is further suspended from the frame 18 by the left lift cylinder 32 and the right lift cylinder 34. The left lift cylinder 32 is multi-dimensional rotationally connected to the drawbar 82 by a left lift cylinder connector or ball joint 86, and the right lift cylinder 34 is also multi-dimensional rotationally connected to the drawbar 82 by a right lift cylinder connector or ball joint 88. The side shift cylinder 36 may also be multi-dimensional rotationally connected to the drawbar 82 by a second side shift cylinder connector or ball joint 90. The second side shift cylinder connection 90 may be proximate the right lift cylinder connection 88 as shown herein and provide a connection between the link bar 38 and the drawbar 82 to shift the link bar 38 and/or the drawbar 82 laterally when the side shift cylinder 36 is extended and retracted to adjust a drawbar yaw angle relative to the frame 18. The positions of the first side shift cylinder connection 80 and the second side shift cylinder connection 90 may be varied as necessary to achieve a desired performance of the blade control system 24 so long and extension and retraction of the side shift cylinder 36 causes relative lateral movement between the link bar 38 and the drawbar 82.

Figure 3:
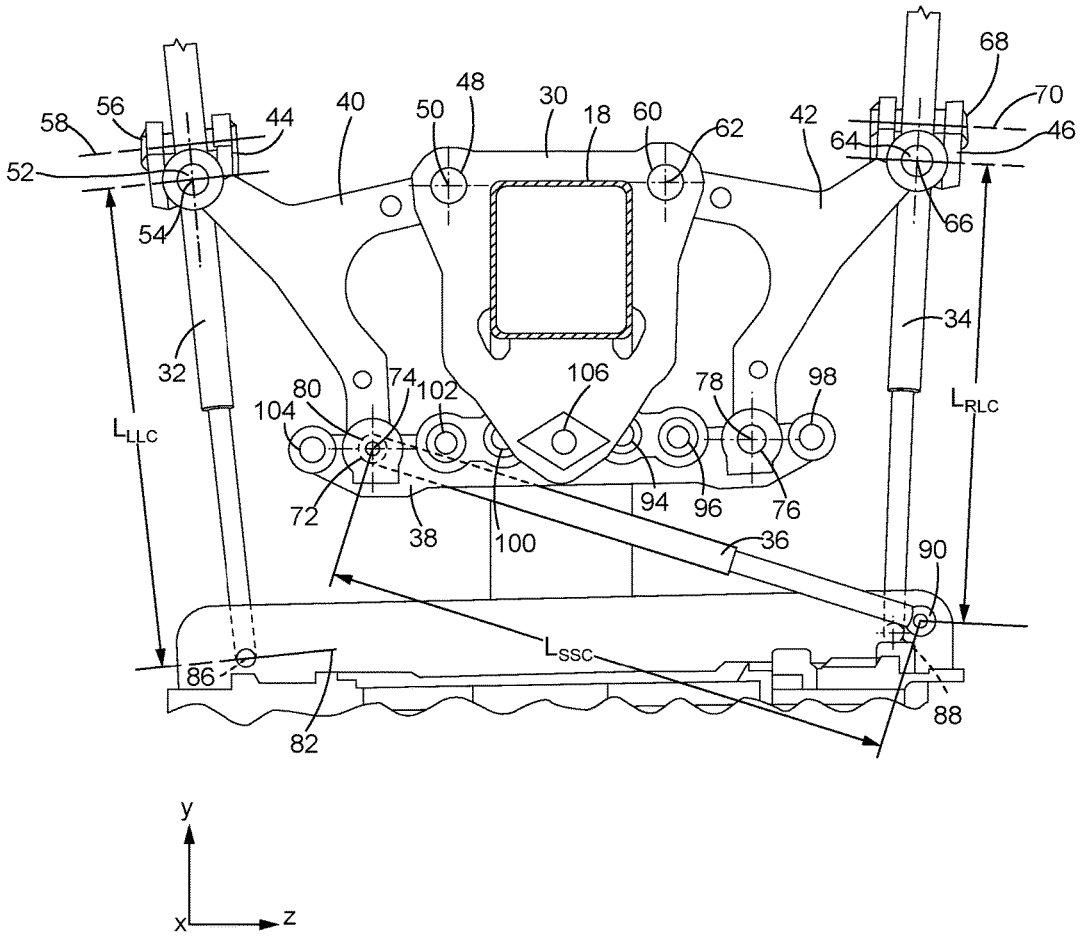
FIG. 3 is a rear view of the front portion of the motor grader of FIG. 1 with a link bar in a center position and engaged by a center pin to maintain the center position.
Figure 4:
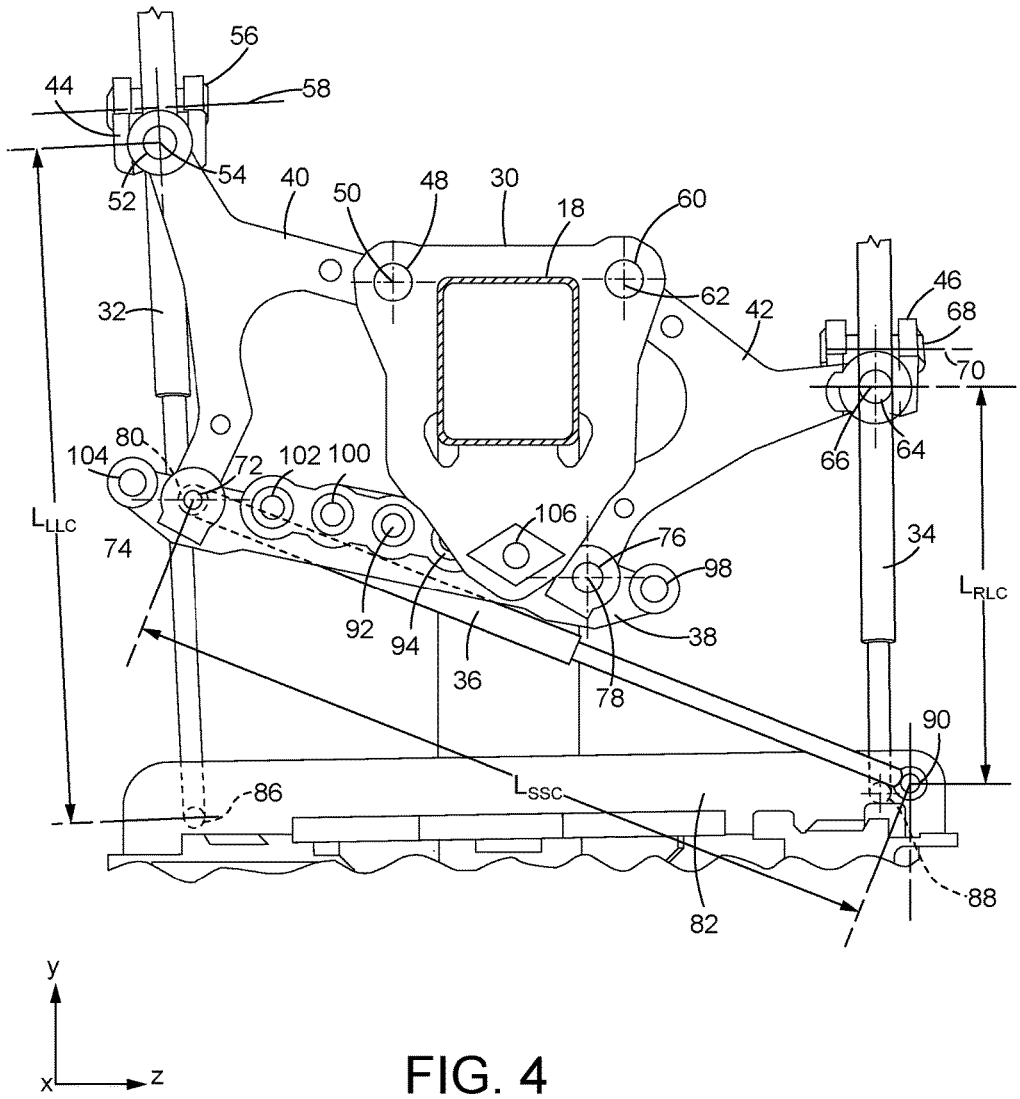
FIG. 4 is the rear view of the front portion of the motor grader of FIG. 3 with the link bar shifted to a left position and engaged by the center pin to maintain the left position.
Figure 5:
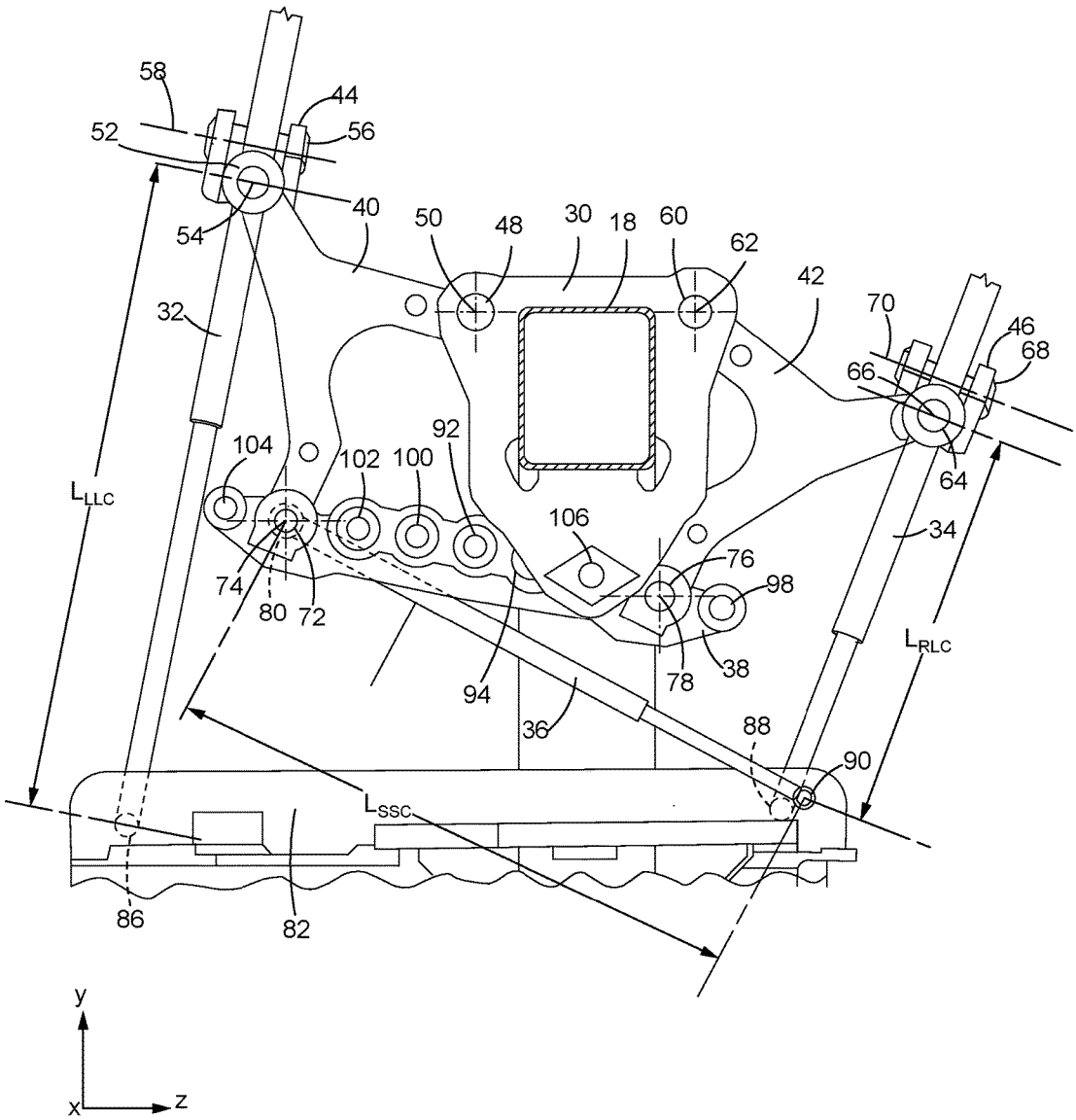
FIG. 5 is the rear view of the front portion of the motor grader of FIG. 3 with the link bar shifted to the left position of FIG. 4 and a drawbar shifted to the left.

The link bar 38 may be configured to be positioned and locked in place relative to the frame 18 and the side shift mounting bracket 30 at any one of a plurality of discrete positions. Referring to FIG. 3, the link bar 38 may have a plurality of link bar holes 92-104 extending there through and spaced along the length of the link bar 38. A center pin 106 may be operatively connected to the frame 18 and mounted on the side shift mounting bracket 30, and be selectively extendable for insertion into one of the plurality of link bar holes 92-104 disposed proximate the center pin 106 to fix the left lift arm 40, the right lift arm 42 and the link bar 38 relative to the frame 18. Referring to the position of the link bar 38 with respect to the frame 18, the link bar holes may include a center hole 92, a left center hole 94, a left hole 96, a far left hole 98, a right center hole 100, a right hole 102 and a far right hole 104. As shown in FIG. 3, the link bar 38 is positioned at a center position with the center pin 106 extending through the center hole 92. The lift arms 40, 42 and the link bar 38 are held in the illustrated position and forces tending to rotate the lift arms 40, 42 and shift the link bar 38 laterally are not transferred to the side shift cylinder 36. When desired to move the link bar 38 to another one of the discrete positions such as the left position as shown in FIG. 4, the center pin 106 may be retracted, the lift cylinders 32, 34 and the side shift cylinder 36 may be actuated to move the link bar 38 to the left, and the center pin 106 may again be extended and inserted into the left hole 96 when the left hole is aligned to lock the link bar 38 in the left position. With the link bar 38 locked in position, the lift cylinders 32, 34 and the side shift cylinder 36 may be actuated to move the drawbar 82 relative to the frame 18, the link bar 38 and the lift arms 40, 42 to positions such as that shown in FIG. 5.

As the lift cylinders 32, 34 and/or the side shift cylinder 36 are actuated, the DCM assembly 20 may pivot about the drawbar ball joint 84. Referring back to FIGS. 1 and 2, a circle assembly 108 including a circle 110 and one or more connecting beams 112 may be connected to the drawbar 82 via a motor (not shown) to drivingly support a blade or moldboard assembly 114 attached to the connecting beams 112 and having a blade 116 that is positionable by one or more blade positioning cylinders 118. In addition to the DCM assembly 20 being both vertically and horizontally positioned relative to the frame 18, the DCM assembly 20 may also be controlled to rotate the circle assembly 108 and the blade assembly 114 relative to the drawbar 82. The blade 116 may be moveable both horizontally and vertically, and oriented relative to the circle assembly 108 via the blade positioning cylinder(s) 118.

Figure 6:
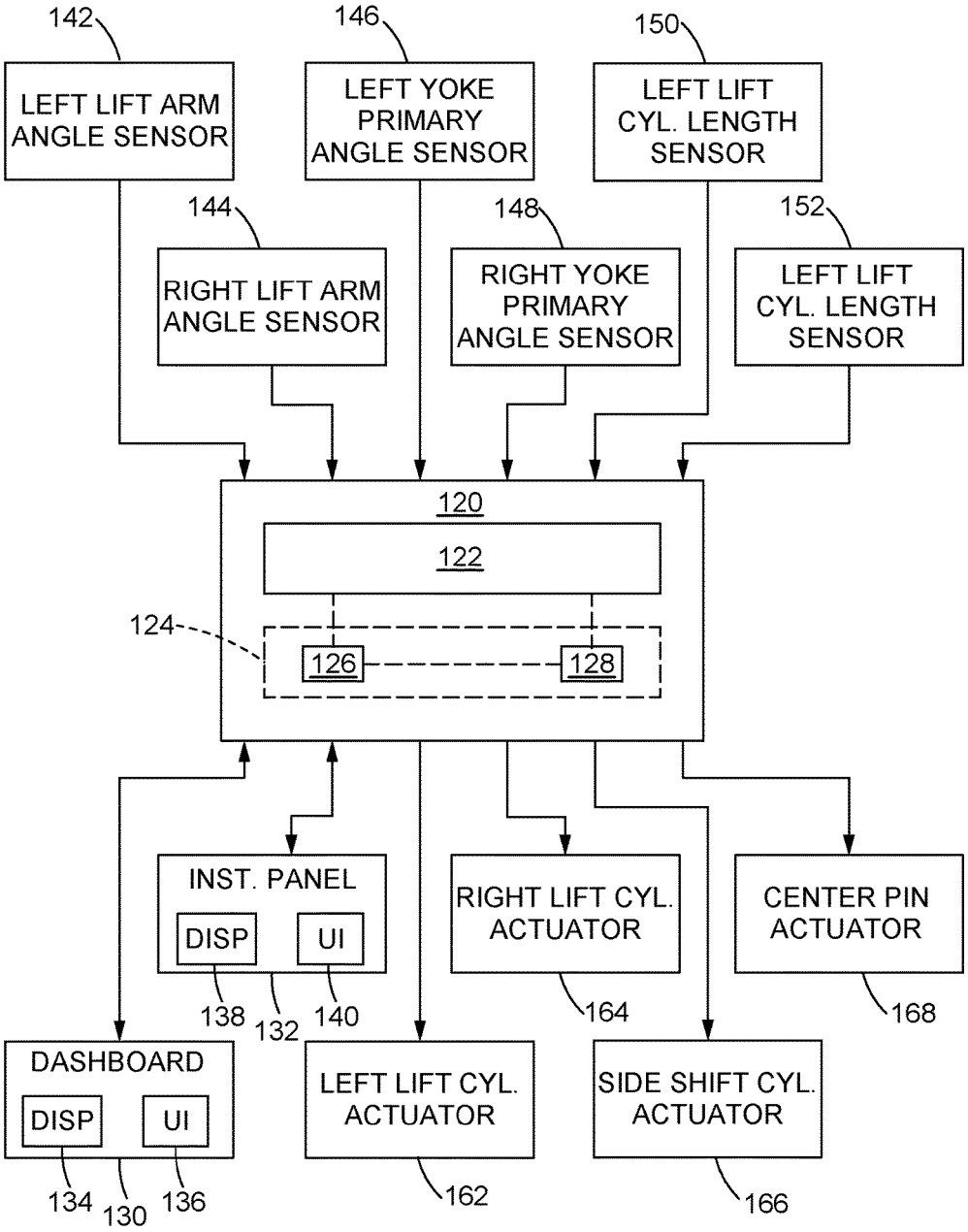
FIG. 6 is a schematic view of electrical components of a blade control system of the motor grader of FIG. 1.

Referring now to FIG. 6, the motor grader 10 may include various control components that are integrated into the blade control system 24. The motor grader 10 may include a controller 120 capable of receiving information in signals from control devices, sensors and other input devices, processing the received information using software stored therein, and outputting information to output devices such as actuators and displays that cause the motor grader 10 to operate and provide information to an operator of the motor grader 10. The controller 120 may include a microprocessor 122 for executing a specified program, which controls and monitors various functions associated with the motor grader 10. The microprocessor 122 includes a memory 124, such as read only memory (ROM) 126, for storing a program, and a random access memory (RAM) 128 which serves as a working memory area for use in executing the program stored in the memory 124. Although the microprocessor 122 is shown, it is also possible and contemplated to use other electronic components such as a microcontroller, an ASIC (application specific integrated circuit) chip, or any other integrated circuit device. While the discussion provide herein relates to the functionality of the blade control system 24, the controller 120 may be configured to control other aspects of the operation of the motor grader 10. Moreover, the controller 120 may refer collectively to multiple control and processing devices across which the functionality of the blade control system 24 may be distributed.

The operator station 22 (FIG. 1) may embody an area of the motor grader 10 configured to house an operator and provide control devices for the blade control system 24 and the other functions of the motor grader 10. The operator station 22 may include a dashboard 130 and an instrument panel 132 containing dials and/or controls for conveying information and for operating the motor grader 10 and its various components. As illustrated in FIG. 6, the dashboard 130 may include a display system 134 and a user interface 136. In addition, instrument panel 132 may include a display system 138 and a user interface 140. The display systems 134, 138 and the user interfaces 136, 140 may be in communication with the controller 120 of the blade control system 24. The display systems 134, 138 may include a computer monitor with an audio speaker, video screen, and/or any other suitable visual display device that conveys information from the controller 120 to the operator in a sensory perceptible format. It is further contemplated that the user interfaces 136, 140 may include a keyboard, a touch screen, a number pad, a joystick, or any other suitable input devices that may be actuated by the operator and communicate command signals to the controller 120 for execution of functions by the blade control system 24.

The blade control system 24 may move the blade 116 to commanded positions in response to the command signals received from dashboard 130 and/or the instrument panel 132. To properly position the blade 116, it may be necessary to know the positions, orientations and other parameters of the various components of the DCM assembly 20. Some of the necessary information may be measured directly by sensors or other appropriate means, while other information may be calculated based on the measured information. In the illustrated embodiment, the blade control system 24 may directly measure parameters via a left lift arm angle sensor 142, a right lift arm angle sensor 144, a left yoke primary angle sensor 146 a right yoke primary angle sensor 148, a left lift cylinder length sensor 150 and a right lift cylinder length sensor 152 that may each transmit corresponding sensor signals to the controller 120. It is contemplated that blade control system 24 may include other sensors depending on the particular implementation in the motor grader 10.

Figure 7:
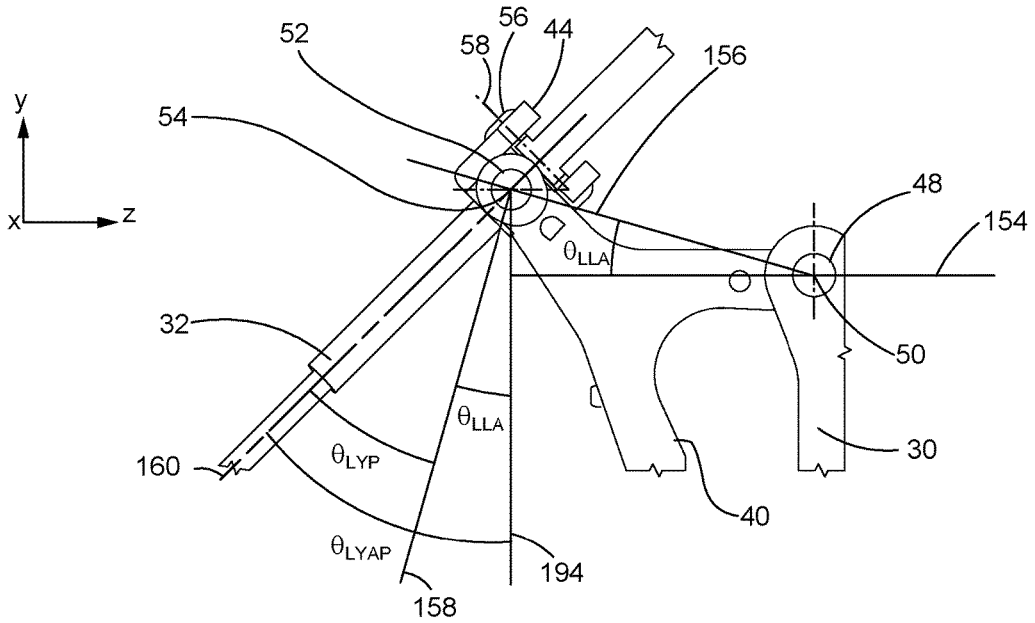
FIG. 7 is a rear view of a left lift arm, a left yoke and a left lift cylinder of the motor grader of FIG. 1.

The left lift arm angle sensor 142 and the right lift arm angle sensor 144 may sense rotational angles of the left lift arm 40 and the right lift arm 42 about the left lift arm axis 50 and the right lift arm axis 62, respectively. For example, lift arm angle sensors 142, 144 may embody magnetic pickup type sensors associated with a magnet (not shown) embedded within protruding portions of the side shift mounting bracket 30. As the left lift arm 40 rotates about the left lift arm axis 50, the left lift arm angle sensor 142 may sense a left lift arm angle $\theta_{LLA}$ relative to the frame 18 and output a left lift arm angle sensor signal that corresponds to the left lift arm angle $\theta_{LLA}$ to the controller 120. As illustrated in FIG. 7, the left lift arm angle $\theta_{LLA}$ may represent the angle between a horizontal line 154 through the left lift arm axis 50 and a line 156 through the left lift arm axis 50 and the left yoke primary axis 54. The right lift arm angle sensor 144 may sense a right lift arm angle $\theta_{RLA}$ of the right lift arm 42 relative to the frame 18 using a similar convention and output a right lift arm angle sensor signal that corresponds to the right lift arm angle $\theta_{RLA}$ to the controller 120. It is contemplated that lift arm angle sensors 142, 144 may alternatively embody another type of angular position sensors such as, for example, optical sensors, rotation sensors that may be coupled to the lift arm pivot pins 48, 60, radio frequency resonance sensors, rotary potentiometers, articulation angle sensors and the like.

The left yoke primary angle sensor 146 and the right yoke primary angle sensor 148 may be rotational sensors of the types described above, and may sense rotational angles of the left yoke 44 and the right yoke 46 relative to the left lift arm 40 and the right lift arm 42 about the left yoke primary axis 54 and the right yoke primary axis 66, respectively. As the left yoke 44 rotates about the left yoke primary axis 54, the left yoke primary angle sensor 146 may sense a left yoke primary angle $\theta_{LYP}$ relative to the left lift arm 40 and output a left yoke primary angle sensor signal that corresponds to the left yoke primary angle $\theta_{LYP}$ to the controller 120. Referring again to FIG. 7, the left yoke primary angle $\theta_{LYP}$ may represent the angle between a line 158 through the left yoke primary axis 54 and perpendicular to the line 156 and a left lift cylinder longitudinal axis 160. The right yoke primary angle sensor 148 may sense a right yoke primary angle $\theta_{RYP}$ of the right yoke 46 relative to the right lift arm 42 using a similar convention and output a right yoke primary angle sensor signal that corresponds to the right yoke primary angle $\theta_{RYP}$ to the controller 120.

The left lift cylinder length sensor 150 and the right lift cylinder length sensor 152 may sense the extension and retraction of the left lift cylinder 32 and the right lift cylinder 34, respectively. In particular, the lift cylinder length sensors 150, 152 may embody magnetic pickup type sensors associated with magnets (not shown) embedded within the piston assemblies of the lift cylinder length sensors 150, 152. As the left lift cylinder 32 extends and retracts, the left lift cylinder length sensor 150 may sense an amount of extension of the left lift cylinder 32 and output a left lift cylinder length sensor signal that corresponds to the amount of extension so that the controller 120 can convert the amount of extension into a left lift cylinder length $L_{LLC}$ from the left yoke primary axis 54 to a center of the left lift cylinder connection 86 that is connected to the drawbar 82. The right lift cylinder length sensor 152 may similarly sense an amount of extension of the right lift cylinder 34 and output a right lift cylinder length sensor signal that corresponds to the amount of extension so that the controller 120 can convert the extension into a right lift cylinder length $L_{RLC}$ from the right yoke primary axis 66 to a center of the right lift cylinder connection 88 that is connected to the drawbar 82. In alternative embodiments, the lift cylinder length sensors 150, 152 may embody other types of linear or position sensors such as, for example, magnetostrictive-type sensors associated with a wave guide internal to the lift cylinders 32, 34, cable type sensors associated with cables externally mounted to the lift cylinders 32, 34, internally or externally mounted optical type sensors, or any other type of linear or distance sensor known in the art.

The controller 120 may also be electrically connected to output devices to which control signals are transmitted to control the position of the DCM assembly 20 and the blade 116. For purposes of the present disclosure in particular, the controller 120 may be connected to and communicate with a left lift cylinder actuator 162, a right lift cylinder actuator 164, a side shift cylinder actuator 166 and a center pin actuator 168. The actuators 162, 164, 166, 168 may be operatively coupled to the corresponding cylinders 32, 34, 36 and the center pin 106 to cause pressurized fluid flow and cause the cylinders 32, 34, 36 and the center pin 106 to extend and retract to position the drawbar 82 and, correspondingly, the blade 116. The actuators 162, 164, 166, 168 may be a solenoid or other type of actuator to which the controller 120 may output control signals or solenoid current to move a corresponding valve element (not shown) to positions to create fluid flow to the cylinders 32, 34, 36 and the center pin 106 corresponding to commands from an operator at the dashboard 130 and/or the instrument panel 132. In alternative embodiments, the actuators 162, 164, 166, 168 may be any other appropriate actuation device capable of converting the control signals from the controller 120 into extension and retraction of the cylinders 32, 34, 36 and the center pin 106.

INDUSTRIAL APPLICABILITY

Figure 9:
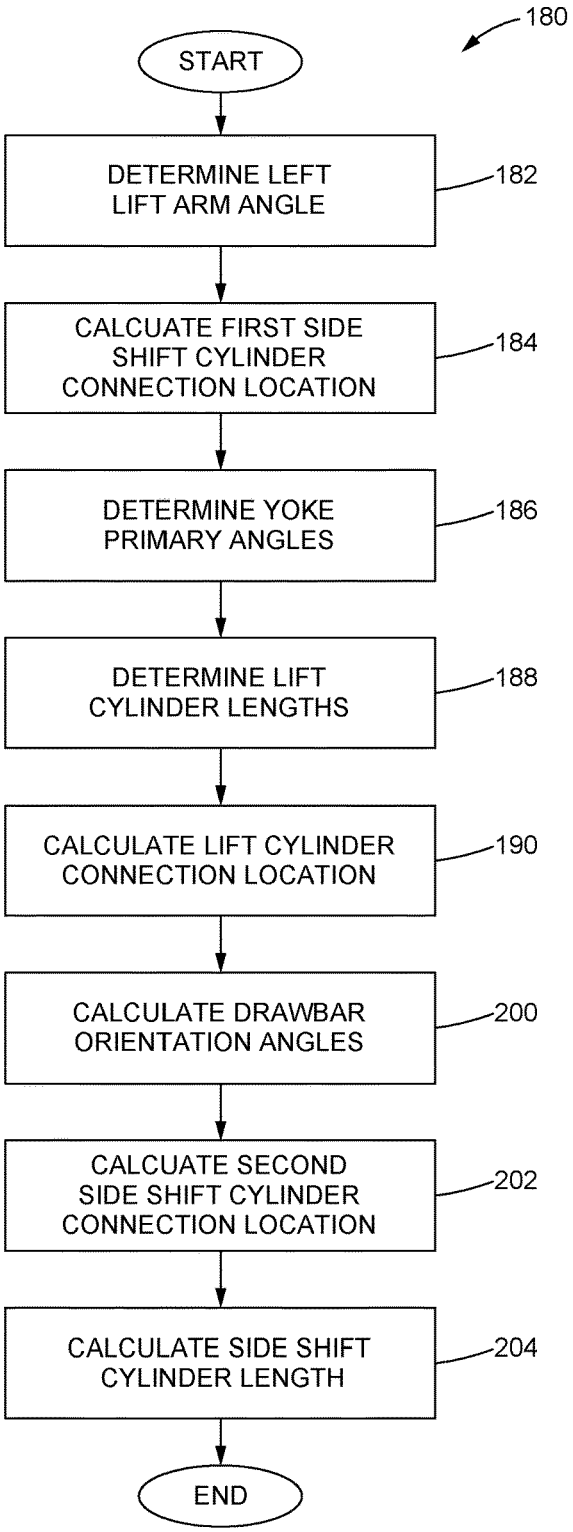
FIG. 9 is a block diagram of a drawbar position and side shift cylinder length calculation routine in accordance with the present disclosure that may be executed by a controller of the motor grader of FIG. 1.

While many of important parameters of the DCM assembly 20 may be determined via sensors, such as the parameters sensed by the lift arm angle sensors 142, 144, the yoke primary angle sensors 146, 148 and the lift cylinder length sensors 150, 152 discussed above, it may be impractical to directly determine values for some parameters that are necessary for understanding the total blade position for of the blade 116 and accurately positioning the blade 116 during operation of the motor grader 10. For example, the side shift cylinder 36 as illustrated herein may be located in a confined area of the DCM assembly 20 that may limit the space available to implement a linear sensor that can measure a side shift cylinder length $L_{SSC}$ of the side shift cylinder 36. In the present disclosure, additional parameters may be calculated from known and measured parameters according to a drawbar position and side shift cylinder length calculation routine 180 as shown in FIG. 9.

The routine 180 may begin at a block 182 where the controller 120 may determine the left lift arm angle $\theta_{LLA}$ from the left lift arm angle sensor signals transmitted by the left lift arm angle sensor 142. With the left lift arm angle $\theta_{LLA}$ known, control may pass to a block 184 where the controller 120 may calculate the location of the first side shift cylinder connection 80 to the link bar 38. In one embodiment, a global coordinate system may be used having its origin on the frame 18 at a center of rotation of the drawbar ball joint 84 with the X-axis aligned parallel to a longitudinal axis of the frame 18, the Y-axis extending vertically and the Z-axis being horizontal and transverse to the longitudinal axis of the frame 18. The X-axis may be positive in the forward direct and negative in the aft direction, the Y-axis may be positive as it extends upward, and the Z-axis may be positive to the right. Also, the lift arm axes 50, 62, the yoke primary axes 54, 66 and the link bar axes 74, 78 may be parallel to the X-axis so that the link bar 38, the lift arms 40, 42 and the yokes 44, 46 move within YZ planes and maintain constant coordinates along the X-axis.

As mentioned previously, the side shift mounting bracket 30, the link bar 38 and the lift arms 40, 42 form a four-bar linkage with known link lengths. In the present embodiment, the first side shift cylinder connection 80 may be centered approximately on the left link bar axis 74 so that the distance to the left lift arm axis 50 is constant. Consequently, the Y- and Z-coordinates of the first side shift cylinder connection 80 may be calculated by the controller 120 based on the known Y- and Z-coordinates of the left lift arm axis 50, the sensed left lift arm angle $\theta_{LLA}$ and the known distance between the axes 50, 74 in the YZ plane, with the X-coordinate is known and constant as discussed above. The calculation may also be performed using the left lift arm angle $\theta_{RLA}$ that will also make the other angles and the positions of the link bar axes 74, 78 determinate. Alternatively, because the link bar 38 and the four-bar linkage have a finite number of discrete positions due to the link bar holes 92-104 and the center pin 106, the possible values of the left lift arm angle $\theta_{LLA}$ and corresponding coordinates of the first side shift cylinder connection 80 may be stored in the memory 124 in a look-up table that may be accessed by the controller 120 using the sensed left lift arm angle $\theta_{LLA}$ to reduce processing time and computing resources.

With the location of the first side shift cylinder connection 80 calculated at the block 184, control may pass to a block 186 where the controller 120 determines the left yoke primary angle $\theta_{LYP}$ and the right yoke primary angle $\theta_{RYP}$ based on the yoke primary angle sensor signals. Control may then pass to a block 188 where the controller 120 may determine the left lift cylinder length $L_{LLC}$ and the right lift cylinder length $R_{LLC}$ from the lift cylinder length sensor signals.

Figure 8:
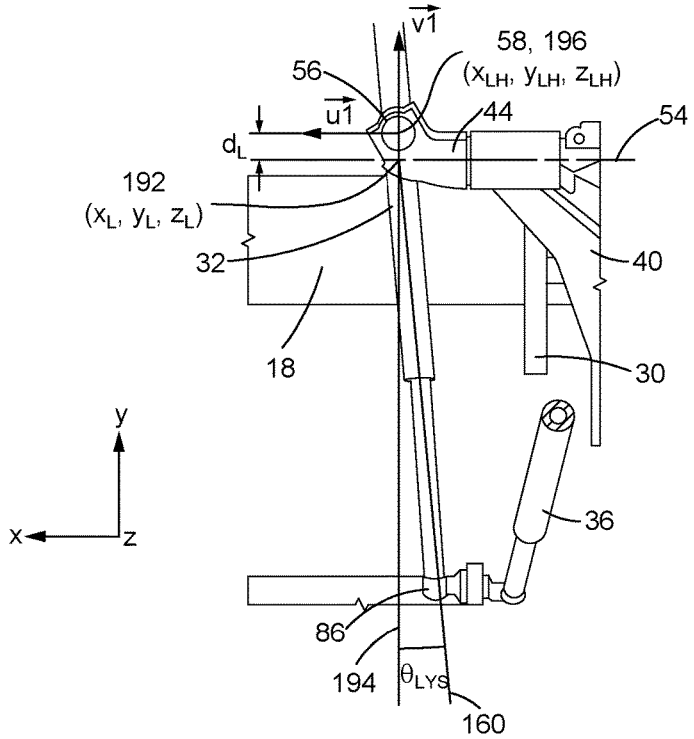
FIG. 8 is a side view of the left lift arm, the left yoke and the left lift cylinder of FIG. 7.

Knowing the lift arm angles $\theta_{LLA}$, $\theta_{RLA}$, the yoke primary angles $\theta_{LYP}$, $\theta_{RYP}$ and the lift cylinder lengths $L_{LLC}$, $L_{RLA}$ may allow the controller 120 to calculate the locations of the left lift cylinder connection 86 and the right lift cylinder connection 88 at a block 190. In one embodiment of calculation logic, a left yoke primary global point 192 (FIG. 8 for the left yoke 44) may be used in the calculation. The left yoke primary global point 192 may have coordinates $x_L$, $y_L$, $z_L$ and a right yoke global point (not shown) may have coordinates $x_R$, $y_R$, $z_R$. Those skilled in the art will understand that the following discussion of the left side of the DCM assembly 20 will apply in a similar manner to the components on the right side of the DCM assembly 20.

The left yoke primary global point 192 may be located at an intersection of the left yoke primary axis 54 and a perpendicular line 194 between the left yoke primary axis 54 and the left yoke secondary axis 58. The left yoke primary global point 192 and a left yoke secondary global point 196 at the intersection of the perpendicular line 194 and the left yoke secondary axis 58 may be separated by a left yoke axis offset distance $d_L$. The coordinates $x_L$, $y_L$, $z_L$ can be found by finding the Y- and Z-coordinates of the left yoke primary axis 54 and the X-coordinate of the left yoke secondary axis.

The Y- and Z-coordinates will change based on the discrete positions of the link bar 38 and the left lift arm angle $\theta_{LLA}$. The coordinates may be calculated, or may be resolved simply by having a look-up table for the coordinates of the left yoke primary global point 192 and the right yoke global point for each position of the link bar 38 based on either the left lift arm angle $\theta_{LLA}$ or the right lift arm angle $\theta_{RLA}$. An example of such a global point coordinate look-up table 198 is shown in FIG. 10.

Once the coordinates $x_L$, $y_L$, $z_L$ are determined, coordinates $x_{LH}$, $y_{LH}$, $z_{LH}$ of the left yoke secondary global point 196 can be calculated. The left yoke secondary pivot pin 56 may also be known as the left lift cylinder head pin 56, and the left yoke secondary global point 196 provides a global location for the left lift cylinder head pin 56. The coordinates $x_{LH}$, $y_{LH}$, $z_{LH}$ may be determined based on the left yoke axis offset distance $d_L$ and a left yoke absolute primary angle $\theta_{LYAP}$ (FIG. 7) that is equal to the sum of the left lift arm angle $\theta_{LLA}$ and the left yoke primary angle $\theta_{LYP}$. The left yoke absolute primary angle $\theta_{LYAP}$ represents the angle between the left lift cylinder longitudinal axis 160 and the perpendicular line 194. The coordinate $x_{LH}$ will be equal to the coordinate $x_L$ of the left yoke primary global point 192. The coordinate $y_{LH}$ will be equal to the coordinate $y_L$ plus $d_L \times \cos(\theta_{LYAP})$, and the coordinate $z_{LH}$ will be equal to the coordinate $z_L$ plus $d_L \times \sin(\theta_{LYAP})$.

The coordinates $x_{LH}$, $y_{LH}$, $z_{LH}$ and the left yoke absolute primary angle $\theta_{LYAP}$ may be used to determine a local coordinate system (FIGS. 7 and 8) with an origin at the left yoke secondary global point 196, a vector $\vec{z1}$ along the left yoke secondary axis 58, a vector $\vec{v1}$, and a vector $\vec{u1}$ that is parallel to the Z-axis. Knowing that the left lift cylinder 32 will rotate about the $\vec{z1}$-axis and remain in the $\vec{u1}\vec{v1}$ plane, the left lift arm length $L_{LLA}$ may be used by the controller 120 to simplify and solve trigonometric functions to determine the location of the left lift cylinder connection 86 to the drawbar 82. In a similar way, the controller 120 determines intermediate parameters on the right side of the DCM assembly 20 such as coordinates $x_{RH}$, $y_{RH}$, $z_{RH}$ and the right yoke absolute primary angle $\theta_{RYAP}$, and calculates the location of the right lift cylinder connection 88 to the drawbar 82.

After the locations of the lift cylinder connections 86, 88 are calculated at the block 190, control may pass to a block 200 where the controller 120 may calculate drawbar orientation angles $\theta_{DBX}$, $\theta_{DBY}$, $\theta_{DBZ}$ for the rotation of the drawbar 82 about the x-axis, the y-axis and the z-axis, respectively, that will define the total drawbar position. The drawbar orientation angles $\theta_{DBX}$, $\theta_{DBY}$, $\theta_{DBZ}$ may be calculated from the global locations of the lift cylinder connections 86, 88 and the constraint of the drawbar 82 being to the frame 18 at the drawbar ball joint 84 at a point having coordinates (0, 0, 0) in the coordinate systems of both the frame 18 and the drawbar 82. Vectors drawn from that point to the locations of the lift cylinder connections 86, 88 define the total drawbar position in the coordinate systems so that the drawbar orientation angles $\theta_{DBX}$, $\theta_{DBY}$, $\theta_{DBZ}$ are determinable by the controller 120. The x-axis orientation angle $\theta_{DBX}$ may correspond to a drawbar roll angle of the drawbar 82 relative to the frame 18, the y-axis orientation angle $\theta_{DBY}$ may correspond to a drawbar yaw angle of the drawbar 82, and the z-axis orientation angle $\theta_{DBZ}$ may correspond to a drawbar pitch angle of the drawbar 82.

Calculation of the locations of the lift cylinder connections 86, 88 may also facilitate determination of the side shift cylinder length $L_{SSC}$ of the side shift cylinder 36 that may have been measured directly in previous machines by a length sensor operatively connected to the side shift cylinder 36. After the locations of the lift cylinder connections 86, 88 are calculated at the block 190, control may also pass to a block 202 where the controller 120 may calculate the location of the second side shift cylinder connection 90 to the drawbar 82. A relative location of the second side shift cylinder connection 90 on the drawbar 82 with respect to one or both of the lift cylinder connections 86, 88 will be fixed and known. With the location of the drawbar 82 fixed and the relationships between the connections 86, 88, 90 known, the location of the second side shift cylinder connection 90 may be calculated using equations that will be apparent to those skilled in the art.

With the location of the first side shift cylinder connection 80 calculated at the block 184 and the location of the second side shift cylinder connection 90 calculated at the block 202, control may pass to a block 204 where the controller 120 may calculate the side shift cylinder length $L_{SSC}$ of the side shift cylinder 36. Knowing the coordinates of the two end points of the side shift cylinder length $L_{SSC}$ (i.e., the locations of the side shift cylinder connections 80, 90), the controller 120 may solve the three-dimensional Pythagorean Theorem to calculate the side shift cylinder length $L_{SSC}$.

With the configuration of the sensors 142-152 and the calculations of the drawbar position and side shift cylinder length calculation routine 180, it is possible to derive the total drawbar position as part of the total blade position without the necessity of directly measuring many relevant parameters of the DCM assembly 20. Utilizing the rotation sensors 142-148 for the lift arms 40, 42 and the yokes 44, 46, it is possible to omit a sensor for directly measuring the side shift cylinder length $L_{SSC}$ where the side shift cylinder 36 is located within a confined space. Moreover, linear sensors can be significantly more expensive than rotary sensors so the arrangement in accordance with the present disclosure may reduce the overall cost of the motor grader 10.

Those skilled in the art will understand that the configuration of the motor grader 10 and the electrical components of the blade control system 24 is exemplary. Variations in the electrical components of the motor grader 10 are contemplated allowing with corresponding modifications to the routine 180. For example, the two lift arm angle sensors 142, 144 and the two yoke primary angle sensors 146, 148 may be provided as illustrated and described herein for redundancy and robustness in the blade control system 24, and the second sensors may reduce the number of calculations and processing resources required of the controller 120 by directly measuring the corresponding angles. However, in alternative embodiments, one of the lift arm angle sensors 142, 144 may be omitted. If the left lift arm angle sensor 142 is provided and the left lift arm angle $\theta_{LLA}$ is directly measured, the right lift arm angle sensor 144 may be omitted, and the right lift arm angle $\theta_{RLA}$ may be calculated based on the known parameters of the four-bar linkage formed by the frame 18, the link bar 38 and the lift arms 40, 42, or obtained from the look-up table 198. Similar calculations may be performed for the left lift arm angle $\theta_{LLA}$ if only the right lift arm angle sensor 144 is provided and measure the right lift arm angle $\theta_{RLA}$.

In other alternative embodiments, only one of the yoke primary angle sensors 146, 148 may be needed for the theoretical solution of the total drawbar position outlined above. Where only the left yoke primary angle sensor 146 is incorporated into the design, the left yoke primary angle $\theta_{LYP}$ may be measured, and the location of the left lift cylinder connection 86 may be calculated as illustrated and described above. With the location of the left lift cylinder connection 86 established, the right yoke primary angle $\theta_{RYP}$ and the location of the right lift cylinder connection 88 may be calculated based on the location of the left lift cylinder connection 86, the right lift arm angle $\theta_{RLA}$ (directly measured or derived), the right lift cylinder length $L_{RLC}$ derived from the right lift cylinder length sensor 152, and the known geometries of the right yoke 46 and the drawbar 82. Similar calculations may be performed to determine the left yoke primary angle $\theta_{LYP}$ and the location of the left lift cylinder connection 86 where only the right yoke primary angle sensor 148 is provided. As will be apparent to those skilled in the art, the total drawbar position may be obtained using up to six sensors or by as few as four sensors as discussed herein, and such variations in the blade control system 24 are contemplated by the inventors as having use in motor graders 10 in accordance with the present disclosure.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A motor grader comprising:

a frame;

a drawbar that is multi-dimensional rotationally connected to the frame;

a left lift arm pivotally connected to the frame;

a right lift arm pivotally connected to the frame;

a link bar pivotally connected to the left lift arm and the right lift arm;

a left yoke pivotally connected to the left lift arm for rotation relative to the left lift arm about a left yoke primary axis;

a left lift cylinder pivotally connected to the left yoke for rotation relative to the left yoke about a left yoke secondary axis, and multi-dimensional rotationally connected to the drawbar;

a right yoke pivotally connected to the right lift arm for rotation relative to the right lift arm about a right yoke primary axis;

a right lift cylinder pivotally connected to the right yoke for rotation relative to the right yoke about a right yoke secondary axis, and multi-dimensional rotationally connected to the drawbar;

a side shift cylinder multi-dimensional rotationally connected to the link bar by a first side shift cylinder connection and multi-dimensional rotationally connected to the drawbar by a second side shift cylinder connection;

a left lift arm angle sensor operatively associated with the left lift arm to sense a left lift arm angle relative to the frame and output a left lift arm angle sensor signal that corresponds to the left lift arm angle;

a left yoke primary angle sensor operatively associated with the left yoke to sense a left yoke primary angle relative to the left lift arm and output a left yoke primary angle sensor signal that corresponds to the left yoke primary angle;

a left lift cylinder length sensor operatively associated with the left lift cylinder to sense a left lift cylinder length of the left lift cylinder and output a left lift cylinder length sensor signal that corresponds to the left lift cylinder length;

a right lift cylinder length sensor operatively associated with the right lift cylinder to sense a right lift cylinder length of the right lift cylinder and output a right lift cylinder length sensor signal that corresponds to the right lift cylinder length; and a controller operatively connected to the left lift arm angle sensor, the left yoke primary angle sensor, the left lift cylinder length sensor and the right lift cylinder length sensor, the controller being configured to calculate drawbar orientation angles of the drawbar relative to the frame based on the left lift arm angle sensor signal, the left yoke primary angle sensor signal, the left lift cylinder length sensor signal and the right lift cylinder length sensor signal.

2. The motor grader of claim 1, wherein the controller being configured to calculate the drawbar orientation angles comprises configuring the controller to:

calculate a left lift cylinder multi-dimensional rotation connection location relative to the frame;

calculate a right lift cylinder multi-dimensional rotation connection location relative to the frame; and calculate a drawbar roll angle, a drawbar yaw angle and a drawbar pitch angle with respect to the frame based on the left lift cylinder multi-dimensional rotation connection location and the right lift cylinder multi-dimensional rotation connection location.

3. The motor grader of claim 2, wherein the link bar has a plurality of link bar holes extending there through, and wherein the motor grader comprises a center pin operatively connected to the frame and selectively extendable for insertion into one of the plurality of link bar holes disposed proximate the center pin to fix the left lift arm, the right lift arm and the link bar relative to the frame.

4. The motor grader of claim 3, wherein the controller is configured to determine the one of the plurality of link bar holes in which the center pin is inserted based on the left lift arm angle of the left lift arm angle sensor signal, and to determine a first side shift cylinder multi-dimensional rotation connection location based on the one of the plurality of link bar holes in which the center pin is inserted.

5. The motor grader of claim 2, wherein the controller is configured to:

determine a first side shift cylinder multi-dimensional rotation connection location based on the left lift arm angle of the left lift arm angle sensor signal;

determine a second side shift cylinder multi-dimensional rotation connection location based on the left lift cylinder multi-dimensional rotation connection location and the right lift cylinder multi-dimensional rotation connection location; and calculate a side shift cylinder length as a distance between the first side shift cylinder multi-dimensional rotation connection location and the second side shift cylinder multi-dimensional rotation connection location.

6. The motor grader of claim 5, wherein the controller is configured to calculate the second side shift cylinder multi-dimensional rotation connection location relative to the frame based on the left lift cylinder multi-dimensional rotation connection location, the right lift cylinder multi-dimensional rotation connection location, and a known relative position of the second side shift cylinder multi-dimensional rotation connection location on the drawbar with respect to a left lift cylinder multi-dimensional rotation connection and a right lift cylinder multi-dimensional rotation connection.

7. The motor grader of claim 2, wherein the controller is configured to:

calculate the left lift cylinder multi-dimensional rotation connection location relative to the frame based on the left lift arm angle of the left lift arm angle sensor signal, the left yoke primary angle of the left yoke primary angle sensor signal and the left lift cylinder length of the left lift cylinder length sensor signal; and calculate the right lift cylinder multi-dimensional rotation connection location relative to the frame based on the left lift cylinder multi-dimensional rotation connection location, a right lift arm angle and the right lift cylinder length of the right lift cylinder length sensor signal.

8. The motor grader of claim 7, wherein the controller is configured to:

calculate a left yoke absolute primary angle relative to the frame by adding the left lift arm angle to the left yoke primary angle; and calculate the left lift cylinder multi-dimensional rotation connection location relative to the frame based on the left yoke absolute primary angle and the left lift cylinder length of the left lift cylinder length sensor signal.

9. The motor grader of claim 2, wherein the controller is configured to calculate a side shift cylinder length from the first side shift cylinder connection to the second side shift cylinder connection based on the left lift arm angle sensor signal, the left yoke primary angle sensor signal, the left lift cylinder length sensor signal and the right lift cylinder length sensor signal.

10. A method for determining drawbar orientation angles of a drawbar of a motor grader that is multi-dimensional rotationally connected to a frame of the motor grader, wherein a link bar of the motor grader is connected to the frame by a left lift arm pivotally connected to the frame and to the link bar and a right lift arm pivotally connected to the frame and to the link bar, and the drawbar is suspended from the frame by a left lift cylinder and a right lift cylinder, wherein the left lift cylinder is multi-dimensional rotationally connected to the drawbar and pivotally connected to a left yoke that is pivotally connected to the left lift arm, and the right lift cylinder is multi-dimensional rotationally connected to the drawbar and pivotally connected to a right yoke that is pivotally connected to the right lift arm, and wherein a side shift cylinder has a first side shift cylinder multi-dimensional rotation connection to the link bar and a second side shift cylinder multi-dimensional rotation connection to the drawbar, the method for determining comprising:

calculating a left lift cylinder multi-dimensional rotation connection location relative to the frame;

calculating a right lift cylinder multi-dimensional rotation connection location relative to the frame; and calculating the drawbar orientation angles of the drawbar relative to the frame based on the left lift cylinder multi-dimensional rotation connection location and the right lift cylinder multi-dimensional rotation connection location.

11. The method of claim 10, wherein the link bar has a plurality of link bar holes extending there through and a center pin is operatively connected to the frame and selectively extendable for insertion into one of the plurality of link bar holes disposed proximate the center pin to fix the left lift arm, the right lift arm and the link bar relative to the frame.

12. The method of claim 11, comprising:

determining a left lift arm angle of the left lift arm relative to the frame;

determining the one of the plurality of link bar holes in which the center pin is inserted based on the left lift arm angle; and calculating a first side shift cylinder multi-dimensional rotation connection location relative to the frame based on the one of the plurality of link bar holes in which the center pin is inserted.

13. The method of claim 11, comprising:

determining a left lift arm angle of the left lift arm relative to the frame;

determining a first side shift cylinder multi-dimensional rotation connection location based on the left lift arm angle.

14. The method of claim 10, comprising:

determining a left lift arm angle of the left lift arm relative to the frame;

determining a left yoke primary angle relative to the left lift arm;

determining a left lift cylinder length of the left lift cylinder;

calculating the left lift cylinder multi-dimensional rotation connection location relative to the frame based on the left lift arm angle, the left yoke primary angle and the left lift cylinder length;

determining a right lift arm angle of the right lift arm relative to the frame;

determining a right lift cylinder length of the right lift cylinder; and calculate the right lift cylinder multi-dimensional rotation connection location relative to the frame based on the left lift cylinder multi-dimensional rotation connection location, the right lift arm angle and the right lift cylinder length.

15. The method of claim 14, comprising:

calculating a left yoke absolute primary angle relative to the frame by adding the left lift arm angle to the left yoke primary angle; and calculating the left lift cylinder multi-dimensional rotation connection location relative to the frame based on the left yoke absolute primary angle and the left lift cylinder length.

16. The method of claim 10, comprising calculating a second side shift cylinder multi-dimensional rotation connection location relative to the frame based on the left lift cylinder multi-dimensional rotation connection location, the right lift cylinder multi-dimensional rotation connection location, and a known relative position of the second side shift cylinder multi-dimensional rotation connection on the drawbar with respect to a left lift cylinder multi-dimensional rotation connection and a right lift cylinder multi-dimensional rotation connection.

17. A motor grader comprising:

a frame;

a drawbar mounted on the frame by a drawbar ball joint;

a left lift arm pivotally connected to the frame;

a right lift arm pivotally connected to the frame;

a link bar pivotally connected to the left lift arm and the right lift arm;

a left yoke pivotally connected to the left lift arm for rotation relative to the left lift arm about a left yoke primary axis;

a left lift cylinder pivotally connected to the left yoke for rotation relative to the left yoke about a left yoke secondary axis, and connected to the drawbar by a left lift cylinder ball joint;

a right yoke pivotally connected to the right lift arm for rotation relative to the right lift arm about a right yoke primary axis;

a right lift cylinder pivotally connected to the right yoke for rotation relative to the right yoke about a right yoke secondary axis, and connected to the drawbar by a right lift cylinder ball joint;

a side shift cylinder connected to the link bar by a first side shift cylinder ball joint and connected to the drawbar by a second side shift cylinder ball joint;

a left lift arm angle sensor operatively connected to the left lift arm to sense a left lift arm angle relative to the frame and output a left lift arm angle sensor signal that corresponds to the left lift arm angle;

a right lift arm angle sensor operatively connected to the right lift arm to sense a right lift arm angle relative to the frame and output a right lift arm angle sensor signal that corresponds to the right lift arm angle;

a left yoke primary angle sensor operatively connected to the left yoke to sense a left yoke primary angle relative to the left lift arm and output a left yoke primary angle sensor signal that corresponds to the left yoke primary angle;

a right yoke primary angle sensor operatively connected to the right yoke to sense a right yoke primary angle relative to the right lift arm and output a right yoke primary angle sensor signal that corresponds to the right yoke primary angle;

a left lift cylinder length sensor operatively connected to the left lift cylinder to sense a left lift cylinder length of the left lift cylinder and output a left lift cylinder length sensor signal that corresponds to the left lift cylinder length;

a right lift cylinder length sensor operatively connected to the right lift cylinder to sense a right lift cylinder length of the right lift cylinder and output a right lift cylinder length sensor signal that corresponds to the right lift cylinder length; and a controller operatively connected to the left lift arm angle sensor, the right lift arm angle sensor, the left yoke primary angle sensor, the right yoke primary angle sensor, the left lift cylinder length sensor and the right lift cylinder length sensor, wherein the controller is configured to:

calculate a left lift cylinder ball joint location relative to the frame based on the left lift arm angle of the left lift arm angle sensor signal, the left yoke primary angle of the left yoke primary angle sensor signal and the left lift cylinder length of the left lift cylinder length sensor signal, calculate a right lift cylinder ball joint location relative to the frame based on the right lift arm angle of the right lift arm angle sensor signal, the right yoke primary angle of the right yoke primary angle sensor signal and the right lift cylinder length of the right lift cylinder length sensor signal, and calculate a drawbar roll angle, a drawbar yaw angle and a drawbar pitch angle relative to the frame based on the left lift cylinder ball joint location and the right lift cylinder ball joint location.

18. The motor grader of claim 17, wherein the link bar has a plurality of link bar holes extending there through, wherein the motor grader comprises a center pin operatively connected to the frame and selectively extendable for insertion into one of the plurality of link bar holes disposed proximate the center pin to fix the left lift arm, the right lift arm and the link bar relative to the frame, and wherein the controller is configured to determine the one of the plurality of link bar holes in which the center pin is inserted based on the left lift arm angle of the left lift arm angle sensor signal, and to determine a first side shift cylinder ball joint location based on the one of the plurality of link bar holes in which the center pin is inserted.

19. The motor grader of claim 17, wherein the link bar has a plurality of link bar holes extending there through, wherein the motor grader comprises a center pin operatively connected to the frame and selectively extendable for insertion into one of the plurality of link bar holes disposed proximate the center pin to fix the left lift arm, the right lift arm and the link bar relative to the frame, and wherein the controller is configured to determine a first side shift cylinder ball joint location based on the left lift arm angle of the left lift arm angle sensor signal.

20. The motor grader of claim 17, wherein the controller is configured to:

calculate a left yoke absolute primary angle relative to the frame by adding the left lift arm angle to the left yoke primary angle;

calculate a right yoke absolute primary angle relative to the frame by adding the right lift arm angle to the right yoke primary angle;

calculate the left lift cylinder ball joint location relative to the frame based on the left yoke absolute primary angle and the left lift cylinder length of the left lift cylinder length sensor signal; and calculate the right lift cylinder ball joint location relative to the frame based on the right yoke absolute primary angle and the right lift cylinder length of the right lift cylinder length sensor signal.

* * * * *